US005329851A

United States Patent [19]

Momot

[11] Patent Number: 5,329,851

[45] Date of Patent: Jul. 19, 1994

[54] FLUIDIC DRIVEN SELF-OSCILLATING PRINTER ROLLER AND METHOD

[75] Inventor: Stnaley Momot, LaGrange, Ill.

[73] Assignee: Rockwell International Corporation, El Segundo, Calif.

[21] Appl. No.: 10,466

[22] Filed: Jan. 28, 1993

Related U.S. Application Data

[63] Continuation of Ser. No. 770,067, Oct. 2, 1991, abandoned.

[51] Int. Cl.[5] ..... B41F 31/14; B41L 27/28; B41L 27/16

[52] U.S. Cl. ..... 101/348; 101/DIG. 38

[58] Field of Search ..... 101/348, 349, DIG. 38, 101/148, 350, 351, 352; 91/508, 520

[56] References Cited

U.S. PATENT DOCUMENTS 3,077,159 2/1963 Ward et al. ..... 101/349
3,983,812 10/1976 Schramm ..... 101/349
5,062,362 11/1991 Kemp ..... 101/348
5,125,340 6/1992 Moore ..... 101/348

FOREIGN PATENT DOCUMENTS 2283780 9/1976 France .
828825 2/1960 United Kingdom .

*Primary Examiner*—J. Reed Fisher
*Attorney, Agent, or Firm*—C. B. Patti; H. F. Hamann

[57] ABSTRACT

A self-oscillating roller assembly (11, 13) and method of oscillating a roller in an offset printing press having an oscillating drive assembly (11) for oscillating a rotationally mounted roller (10, 12) with a source of pneumatic pressure (62) by alternatively applying pressure to pressure chambers (42A, 42B) on opposite sides of the roller (10, 12) to impart a longitudinal force on the oscillating roller (10, 12) from the source of pressure (62) in two opposite directions and a controller (47) for controlling the application of pressure (58, 62) to alternately move the rotationally mounted roller in two opposite directions.

8 Claims, 2 Drawing Sheets

FLUIDIC DRIVEN SELF-OSCILLATING PRINTER ROLLER AND METHOD

This application is a continuation of application Ser. No. 07/770,067, filed Oct. 2, 1991, now abandoned.

BACKGROUND OF THE INVENTION

1. Field of the Invention

This invention relates to an oscillating roller assembly in an offset printing press and, more particularly, to such an oscillating roller assembly in which the oscillating roller is driven to oscillate by means of fluidic pressure.

2. Description of the Related Art Including Information Disclosed Under 37 CFR 1.97–1.99

Offset printing assemblies are well known which employ one or more oscillating rollers in either or both of the dampening liquid roller train and the inking roller train. These oscillating rollers oscillate back and forth in the axial direction while in contact with an ink carrying roller, dampening liquid carrying roller or ink and dampening liquid carrying roller. When such oscillating rollers are used in the dampening liquid train, the uniformity of water film thickness on the printing plate cylinder is enhanced. In addition, use of an oscillating roller increases the speed of cleaning the printing plate during start-up and thereby reduces start-up waste. Further, scumming at the edges of the printing plates is reduced or eliminated which also reduces waste and enhances print quality.

It is known to drive such oscillating rollers via complex gear trains and cams. Due to such complexity, such gear train driven oscillating rollers cannot be used in inking rollers and dampening rollers without tremendous cost.

More recently, such oscillating rollers have been friction driven via contact with vibrating drums which are printer driven and oscillate themselves to cause the oscillating rollers to oscillate. These vibrating drum driven oscillators, or self-oscillating rollers, function successfully but they provide no means for control of the oscillation which is generally random. In addition, such self-oscillating rollers require vibrating drums to drive the oscillatory movement that entail additional complexity and cost of construction and also result in increased cost of maintenance and repairs.

SUMMARY OF THE INVENTION

It is therefore the principal object of the present invention to provide an oscillating printing press roller which employs a fluidic oscillating drive mechanism to overcome the disadvantages in gear driven and vibrating drum driven oscillating rollers described above.

This object is achieved by provision of an oscillating roller assembly having an elongate roller mounted for both rotational movement and oscillating movement along its length with an improved oscillating drive mechanism having a source of fluidic pressure, means for imparting a longitudinal force on the elongate roller from the source of fluidic pressure in at least one of two opposite directions and means connected between the source of pressure and the longitudinal force imparting means for controlling the application of pressure to the longitudinal force imparting means to alternately move the elongate roller in said two opposite directions.

The object of the invention is also achieved by provision of the oscillating roller assembly with a controlling means having a pressure chamber in communication with the elongate roller, a valve interconnected between the pressure source and the pressure chamber and means for automatically actuating the valve to alternately pressurize and depressurize the pressure chamber.

The object of the invention is further achieved by providing an oscillating roller assembly in which said force imparting means includes means for imparting longitudinal force on the elongate roller in both of the two opposite directions.

The object of the invention is to provide such an oscillating roller assembly in which the elongate roller has a pair of opposite ends and the longitudinal force imparting means includes a pair of pressure chambers in fluidic communication with the pair of opposite ends.

Another object of the invention is to provide such an oscillating roller in which said longitudinal force imparting means includes a socket for mounting the elongate roller for rotary movement and means for mounting the socket for movement in a longitudinal direction relative to the elongate roller.

The object of the invention is also achieved by provision of an oscillating roller assembly with a roller socket for mounting one end of an elongate roller for rotational movement, an elongate collar protectively surrounding an axle of another roller in rolling contact with the elongate roller and means for mounting the roller socket for translational movement along the length of the elongate collar.

Still a further object is provision of in the oscillating roller assembly of a controlling means includes means for varying the rate at which said pressure is applied to the force imparting means to vary the frequency of oscillation of the elongate roller.

This object is also achieved by provision of a method of oscillating one roller along another roller with which it is in rolling contact, comprising the steps of:

(a) applying a fluidic pressure to one end of the one roller to move it relative to the other roller in one direction;

(b) applying a fluidic pressure to the other end of the one roller to move it relative to the other roller in a direction opposite to the one direction;

(c) alternatively repeating steps (a) and (b).

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENTS

Figure 1:
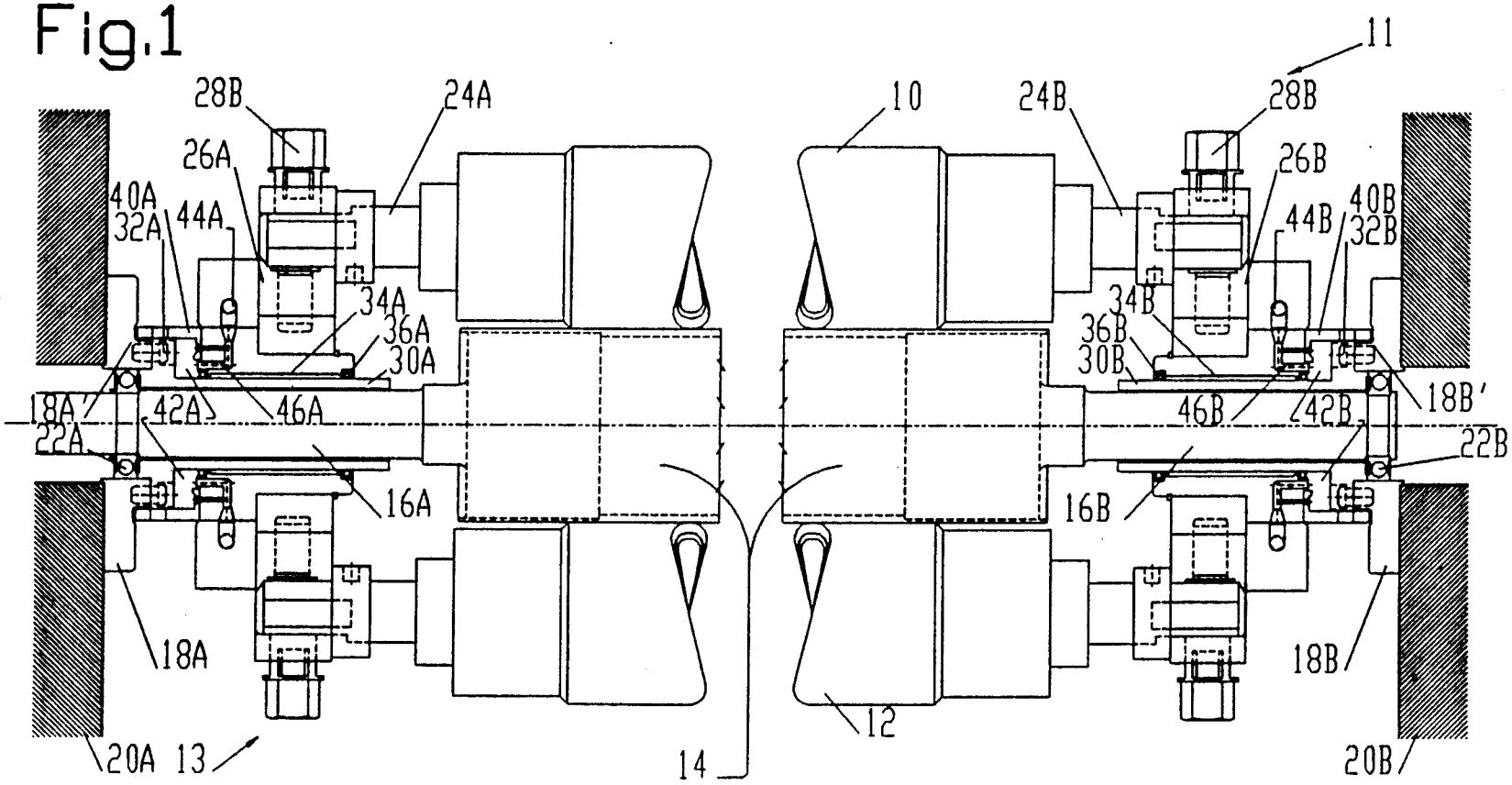
FIG. 1 is a side view illustration of a preferred embodiment of the oscillating roller assembly in which a plurality of oscillating rollers are driven by a single fluidic oscillating drive mechanism of the present invention.

Referring now to FIG. 1, a pair of oscillating rollers 10 and 12 of oscillating roller assemblies 11 and 13 constructed in accordance with the present invention is shown as used to oscillate while in rolling contact with a dampener roller 14. The dampener roller 14 is a direct dampener roller in the dampening train of an offset printing press or the like, but generally the invention can be employed in conjunction with any roller in either the dampening roller train or the ink roller train. Oscillating rollers 10 and 12 have rubber-like surfaces while dampener roller 14 has a chrome surface.

The nonoscillating dampener roller 14 is mounted for rotation by means of a pair of centrally aligned stub axles 16A and 16B at opposite ends of the dampener roller 14 which are received within the cylindrical bores of a pair of mating mounting brackets 18A and 18B, respectively. The mounting brackets, in turn, are respectively secured to pit walls 20A and 20B. Rotation of stub axles 16A and 16B within the cylindrical bores of the associated mounting brackets 18A and 18B is facilitated by rotary bearings 22A and 22B.

The oscillating roller assemblies 11 and 13 are substantially identical with each other. Accordingly, for purposes of simplicity only those parts associated with the upper oscillating roller assembly will be numbered in the drawing and described below with the understanding that the same description of structure and operation applies to the corresponding parts associated with the lower oscillating roller assembly 13. It should also be understood that although preferably two oscillating rollers are associated with the dampener roller 14, a greater or less number could be provided and driven in the same fashion as described herein.

Both of the oscillating roller assemblies 11 and 13 are mounted to the stub axles 16A and 16B of the dampener roller 14. Oscillating rollers 10 and 12 also have centrally aligned stub axles 24A and 24B at their opposite ends which are respectively mounted for rotation to roller sockets 26A and 26B. The roller sockets 26A and 26B, in turn, are mounted for translational movement along the length of stub axles 16A and 16B, respectively, as described below with reference to oscillating roller assembly 11, only.

Still referring to FIG. 1, the stub axles 24A and 24B of oscillating roller 10 are mounted for rotation to roller sockets 26A and 26B, respectively. Adjustment screws 28A and 28B are provided to adjust the level of stub axles 24A and 24B relative to the dampener roller 14 and thereby adjust the pressure between the dampener roller 14 and the oscillating roller 10.

Elongate, T-shaped, annular collars 30A and 30B which protectively surround substantially the entire lengths of stub axles 16A and 16B are respectively secured to mounting brackets 18A and 18B by countersunk screws 32A and 32B, respectively. The stem portions of the collars 30A and 30B receive the stub axles 16A and 16B, respectively, therethrough while the cross bar parts of the T are flush mounted with associated collars 18A' and 18B' of the mounting brackets 18A and 18B at the other end, or cross bar part, of the T to provide a smooth, continuous outer surface. The mounting brackets 26A and 26B carry cylindrical bushings 34A and 34B with lubrication seals 36A and 36B to facilitate translational movement back and forth along the stem portions of the collars 30A and 30B received therethrough, respectively, during oscillation.

Other annular collars 40A and 40B carried by an inner part of the roller sockets 26A and 26B, respectively, snugly receive therewithin the cross bar part of the T-shaped collars 30A and 30B, respectively, and the flush mounted collars 18A' and 18B' of the mounting brackets 18A and 18B, respectively.

The relative dimensions of the above parts create pressure chambers 42A and 42B. For purposes that will be described in detail with reference to FIG. 2, pneumatic inlets 44A and 44B in the roller sockets 26A and 26B are connected with passageways 46A and 46B to pressurize and depressurize the pressure chambers 42A and 42B. When pressure chamber 42A is pressurized with a pressure greater than that in pressure chamber 42B, the pressure differential causes the roller sockets 26A and 26B and the oscillating roller 10 carried thereby to move to the right from the central position shown in FIG. 1. Conversely, when the differential between the two pressure chambers 42A and 42B is reversed, the roller sockets 26A and 16B and roller 10 are carried to move to the left. Thus, by causing the pressure differential between the two pressure chambers 42A and 42B to alternate, an oscillating movement is imparted to the roller 10. Since the chambers 42A and 42B are annular, the pressure differentials also cause the roller sockets associated with the oscillating roller 12 to slide back and forth, and both rollers 10 and 12 oscillate in unison. This is advantageously accomplished with only a single pressure control for both rollers 10 and 12.

Figure 2:
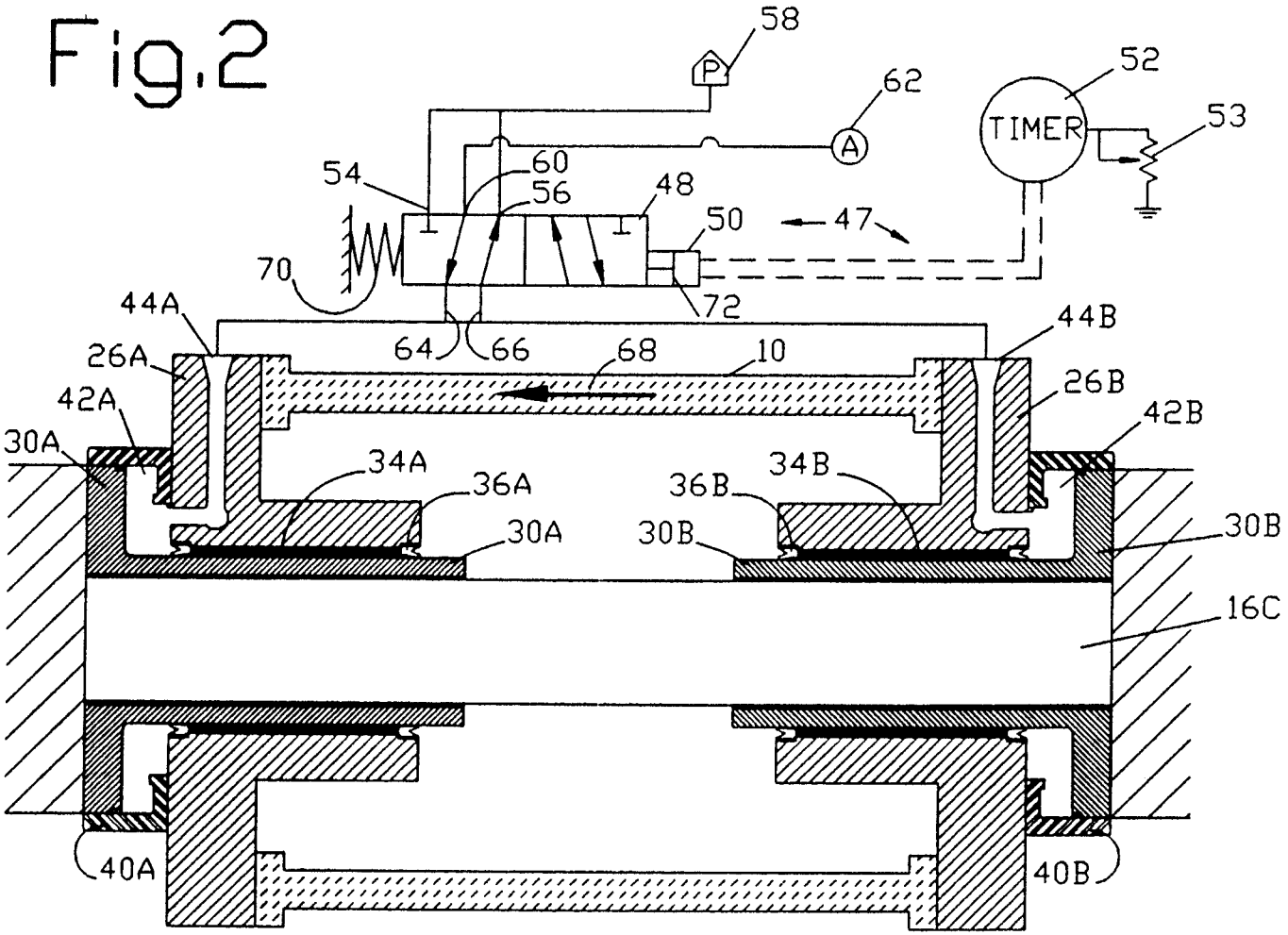
FIG. 2 is a schematic illustration of another embodiment of the oscillating drive mechanism used to oscillate a single oscillating roller of the type shown in FIG. 1 and which illustrates the fluidic pressure controller useable with the embodiments of both FIG. 1 and FIG. 2.

Referring now to FIG. 2 in which parts corresponding to those of FIG. 1 have been given the same reference numeral, the relationship of the pressure chambers 42A and 42B and the pressure passageways 46A and 46B with a preferred embodiment of the pressure application controller 47 is illustrated in which only a single oscillating roller 10 is provided. Instead of the oscillating roller socket being mounted on the stub axles 16A and 16B of the dampener roller 14, however, the oscillating roller 10 is mounted for sliding motion on its own axle 16C.

The pressure controller comprises a multiport pressure valve 48, which is mechanically controlled by a solenoid 50 which, in turn, is controlled by an electronic oscillator, or timer, 52. Advantageously, the period of oscillation can be varied by means of a potentiometer 53 or the like which is not possible with known gear driven or vibrating drum driven oscillating rollers. The multiport pressure valve has two inlet ports 54 and 56 connected to a suitable source of pressure 58 and a third inlet 60 connected to atmosphere 62. Two outlet ports 64 and 66 are respectively connected to inlet ports 44A and 44B, respectively, of the roller sockets 26A and 26B.

The oscillator, or timer 52, has two states between which it oscillates. In one state, such as that shown in FIG. 2, the solenoid 50 is energized and the multiport valve 48 is moved to the position as shown in FIG. 2 in which atmosphere 62 is coupled through valve inlet port 60 and valve outlet port 64 to roller socket inlet port 44A to vent the pressure chamber 42A to atmosphere. At the same time, the source of pressure 58 is coupled through valve inlet 56, valve outlet 66 and roller socket inlet 44B to pressurize pressure chamber 42B. This causes the roller sockets 26A and 26B and the rollers 10 and 12 to move to the left in the direction of arrow 68. At the end of a preselected time period, the timer 52 automatically changes from the one state to another opposite state to deenergize the solenoid 50. A spring 70 then causes the multiport pressure valve to shift to a new position in which the source of pressure 58 is coupled through valve inlet 54, valve outlet 64 and roller socket inlet 44A to pressure chamber 42A. Concurrently, the multiport valve is shifted to couple atmosphere 62 through valve inlet 60, valve outlet 66 and roller socket inlet 44B to depressurize chamber 42B. When this occurs, the roller 10 moves to the right in opposition to the direction of arrow 68.

Alternatively, timer 52 is a source of pilot pressure which periodically alters the application of input pressure to a pilot pressure responsive device 50 of multiport valve 48 to cause it to alternately pressurize and depressurize pressure chambers 42A and 42B. In such event, the pressure device 50 includes a cylinder with a plunger 72.

While a detailed description of the preferred embodiment of the invention has been given, it should be appreciated that many variations can be made thereto without departing from the scope of the invention as set forth in the appended claims. For instance, although pneumatic pressure driven is preferred, it should be appreciated that hydraulic or other fluidic pressure could be employed in lieu of the use of pneumatic pressure.

We claim:

1. In an oscillating roller assembly having an elongate roller mounted for both rotational movement and oscillating movement along its length and a source of fluidic pressure for forcing said oscillating movement, the improvement being an oscillating drive mechanism, comprising:

means for imparting a longitudinal force on the elongate roller from the source of fluidic pressure in at least one of two opposite direction including a fixedly mounted, T-shaped annular collar with an elongate stem portion and a cross bar part, and another annular collar carried by the elongate roller and aligned to slideably receive the cross bar part therewithin to form an annular pressure chamber; and means connected with the source of pressure for selectively controlling the application of pressure to the pressure chamber to alternatively move the elongate roller in two opposite longitudinal directions.

2. The oscillating roller assembly of claim 1 in which said controlling means includes a valve interconnected between the pressure source and the pressure chamber; and means for actuating the valve to alternately pressurize and depressurize the pressure chamber.

3. The oscillating roller assembly of claim 2 in which said actuating means includes an electronic timer for alternately actuating the valve.

4. The oscillating roller assembly of claim 2 in which said actuating means includes a source of pilot pressure for alternately actuating the valve.

5. The oscillating roller assembly of claim 1 in which said elongate roller has a pair of opposite ends, said pressure chamber being at one end, and said longitudinal force imparting means includes another annular pressure chamber at the other end substantially the same as the annular pressure chamber at the one end, both said pressure chambers being in fluidic communication with the source of pressure through the controlling means.

6. The oscillating roller assembly of claim 5 in which said controlling means includes means for alternately connecting said source of pressure to the pressure chambers.

7. The oscillating roller assembly of claim 6 in which said controlling means includes means for alternately depressurizing the pressure chambers.

8. The oscillating roller assembly of claim 1 including another roller in contact with the elongate roller and supported by an elongate axle.

* * * * *